United States Patent [19]

Hemmelgarn

[11] 4,206,699

[45] Jun. 10, 1980

[54] RETRACTING BOLSTER FOR A PRESS

[75] Inventor: Donald J. Hemmelgarn, Minster, Ohio

[73] Assignee: The Minster Machine Company, Minster, Ohio

[21] Appl. No.: 32,180

[22] Filed: Apr. 23, 1979

[51] Int. Cl.[2] ..... B30B 15/06

[52] U.S. Cl. ..... 100/53; 72/432; 72/448; 72/453.06; 83/563; 100/DIG. 18; 100/264; 100/269 R; 100/295

[58] Field of Search ..... 100/DIG. 18, 53, 257, 100/295, 264, 269 R; 192/150; 72/453.02, 453.05, 453.06, 453.07, 446, 448, 441, 432, 571; 83/563, 623; 267/119

[56] References Cited

U.S. PATENT DOCUMENTS

| | | | |
|---|---|---|---|
| 1,768,504 | 6/1930 | Byerlein | 72/448 |
| 1,858,296 | 5/1932 | Ferris | 72/432 X |
| 1,866,595 | 7/1932 | Glasner | 72/448 |
| 3,049,035 | 8/1962 | Hirst | 72/441 X |
| 3,085,530 | 4/1963 | Williamson | 267/119 X |
| 3,206,960 | 9/1965 | Moxley | 100/53 X |
| 3,400,625 | 9/1968 | Wrona | 83/563 X |
| 3,522,939 | 8/1970 | Rode | 267/119 |
| 3,817,080 | 6/1974 | Zupan | 100/53 X |
| 4,056,965 | 11/1977 | Heiser | 267/119 |

FOREIGN PATENT DOCUMENTS

| | | | |
|---|---|---|---|
| 2350891 | 12/1977 | France | 100/257 |

*Primary Examiner*—Billy J. Wilhite
*Attorney, Agent, or Firm*—Albert L. Jeffers

[57] ABSTRACT

A bolster for a press, such as a mechanical press, which is capable of being easily retracted downwardly so as to increase the die separation thereby enabling easy access to the dies for maintenance. The bolster assembly includes a base mounted to the bed of the press, a bolster supported on the base and guided thereby for rectilinear movement in opposed relation to the bed and slide between an extended position for normal press operation, and a retracted position wherein the separation between the upper and lower dies is sufficient to permit easy access, and a hydraulic piston and cylinder arrangement for rigidly holding the bolster in its extended position when charged with high pressure hydraulic fluid, yet permitting the bolster to retract when the hydraulic pressure is released. A clamping mechanism comprising a plurality of hydraulically actuated wedges clamps the bolster in its extended position against horizontal movement, and means are provided for ensuring that the bolster always returns to the same, accurately located position when it is extended.

18 Claims, 6 Drawing Figures

RETRACTING BOLSTER FOR A PRESS

BACKGROUND OF THE INVENTION

The present invention relates to mechanical presses, and in particular to a retracting bolster assembly which permits the die separation to be increased thereby affording easy access for maintenance purposes, and the like.

Mechanical presses, such as straight side presses and gap frame presses for stamping and drawing, generally comprise a frame having a crown and bed and a slide supported within the frame for reciprocal motion toward and away from the bed. The slide is driven by a crankshaft having a connecting arm connected to the slide, to which is mounted the upper die. The lower die is mounted to a bolster, which in turn is connected to the bed. Such mechanical presses are widely used for blanking and drawing operations, and vary substantially in size and available tonnage depending upon the intended use.

In most cases, the bolster is rigidly secured to the press bed and is not capable of any movement. This means that the maximum separation between the upper and lower dies cannot be changed without increasing the shutheight adjustment by raising the slide.

It is sometimes necessary to perform maintenance on the dies during a press run, but due to the fact that the stroke of the press is normally kept to a minimum for a variety of reasons, there is very little room for the diesetter to work on the dies while they are still in the press. This necessitates removing the dies from the press, which is quite time consuming and results in costly machine down time. In order to afford greater access to the dies while they are still in the press, the present invention provides a retractable bolster which can be dropped away from its normal, operational position.

Although certain prior art presses, both of the mechanical and hydraulic type, have been provided with bolsters and beds which are supported by means of hydraulic or pneumatic cylinders, this support is of a yieldable nature and functions as a die cushion, which yields to the downward force transmitted through the upper die and gives additional motion required in some press operations, such as blanking and drawing. The present invention, on the other hand, provides hydraulic support which is rigid and unyieldable to the downward force transmitted through the upper die, and in this respect functions no differently than a bolster which is rigidly connected to and supported by the press bed.

Some prior art presses are provided with safety bolsters, wherein an abnormally large downward force transmitted to the lower die due to die misalignment or a jammed part will cause the bolster to yield and be moved downwardly so as to relieve the abnormally large force thereby preventing jamming of the press. Such a device differs from the present invention in two respects. Firstly, safety bolsters are capable of only limited retraction, on the order of one-half to threequarters of an inch, and this is clearly not sufficient to enable access to the dies. Secondly, the retraction of a safety bolster is an automatic occurrence, as opposed to the present invention wherein the bolster is retracted by selective operation of a control actuator.

SUMMARY OF THE INVENTION

The present invention overcomes the disadvantages inherent in prior art presses by providing a bolster assembly which is capable of being selectively retracted by the press operator or die setter through a distance of at least two inches, and preferably three inches or more, so as to provide sufficient die separation to enable maintenance to be performed on the dies without removing them from the press.

The bolster is guided on a plurality of pistons and guide pins connected to a base, which in turn is mounted to the press bed, and is raised by hydraulic pressure admitted to bores formed in the bolster within which the pistons are received. The hydraulic pressure is sufficiently great to provide rigid, unyielding support for the bolster in its extended position, although a hydraulic rupture disc may be connected to the circuit to provide overload retraction, if desired. When the bolster is extended, a clamping mechanism exerts clamping pressure thereon so as to rigidly hold the bolster against lateral movement. This, together with a pair of dovetailed rails serves to maintain the bolster in accurate registration during press operation.

The bolster is raised from its retracted position and then pressurized to its final state of 1200 p.s.i. by means of an air over oil high pressure pump. An electric contact switch and a pressure-sensitive switch ensure that the bolster is in its fully extended and fully pressurized state before the press is allowed to operate.

Specifically, the present invention contemplates a press having a frame structure with a crown and a bed, a slide guided by the frame structure for reciprocating movement in opposed relation to the bed, and a bolster assembly mounted to the bed. The bolster assembly comprises a base mounted to the bed, and a bolster having an upper surface in facing relation to the slide and being supported on the base and guided by the base for rectilinear movement in opposed relation to the bed and slide between extended and retracted positions. Hydraulic piston and cylinder means associated with the base and bolster rigidly hold the bolster in its extended postion when charged with hydraulic pressure and permit the bolster to retract when hydraulic pressure is released. Means, such as a clamp assembly, connected to the base rigidly hold the bolster against lateral movement relative to its axis of rectilinear movement when the bolster is in its extended position. The hydraulic pressure is released by a selectively actuatable valve which enables the bolster to retract to its retracted position thereby achieving slide and bolster separation sufficient to permit easy die access for maintenance purposes and the like.

DETAILED DESCRIPTION

Figure 1:
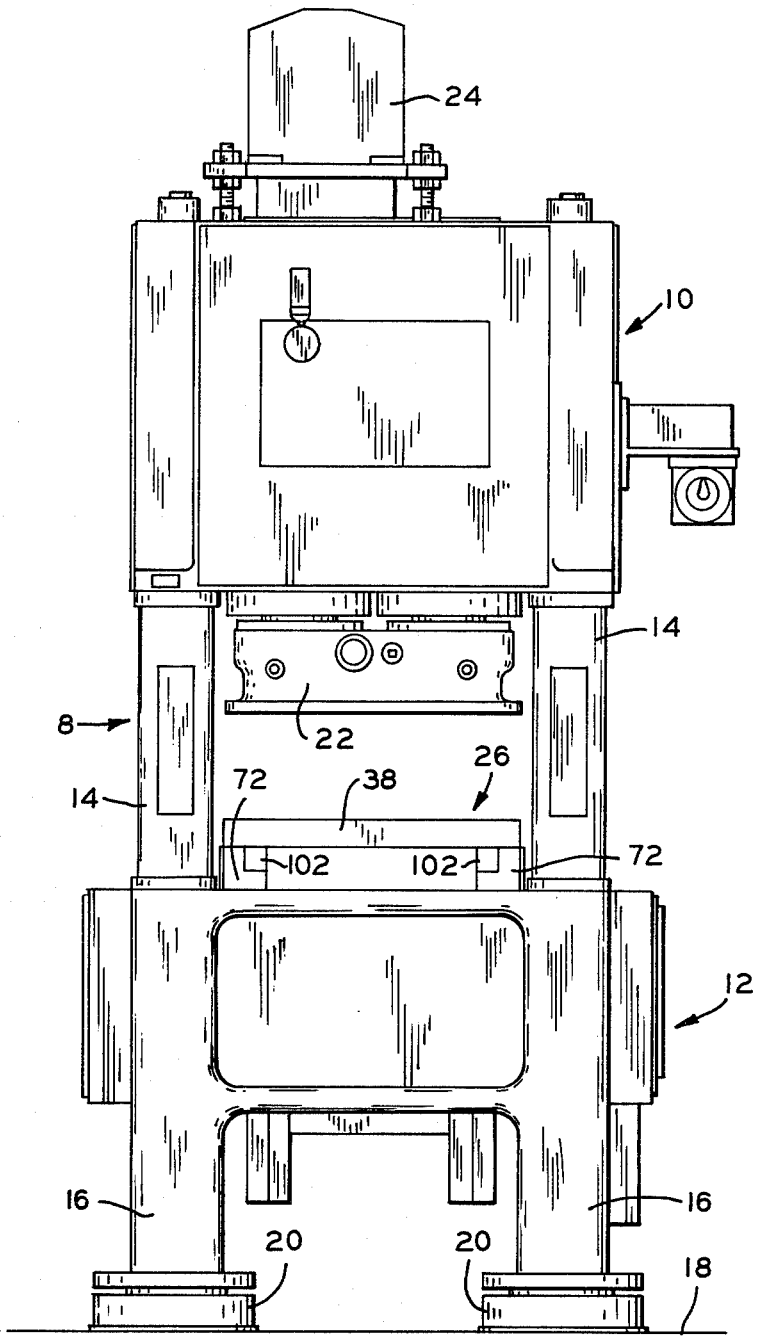
FIG. 1 is a front elevational view of a mechanical press incorporating the retracting bolster of the present invention.
Figure 2:
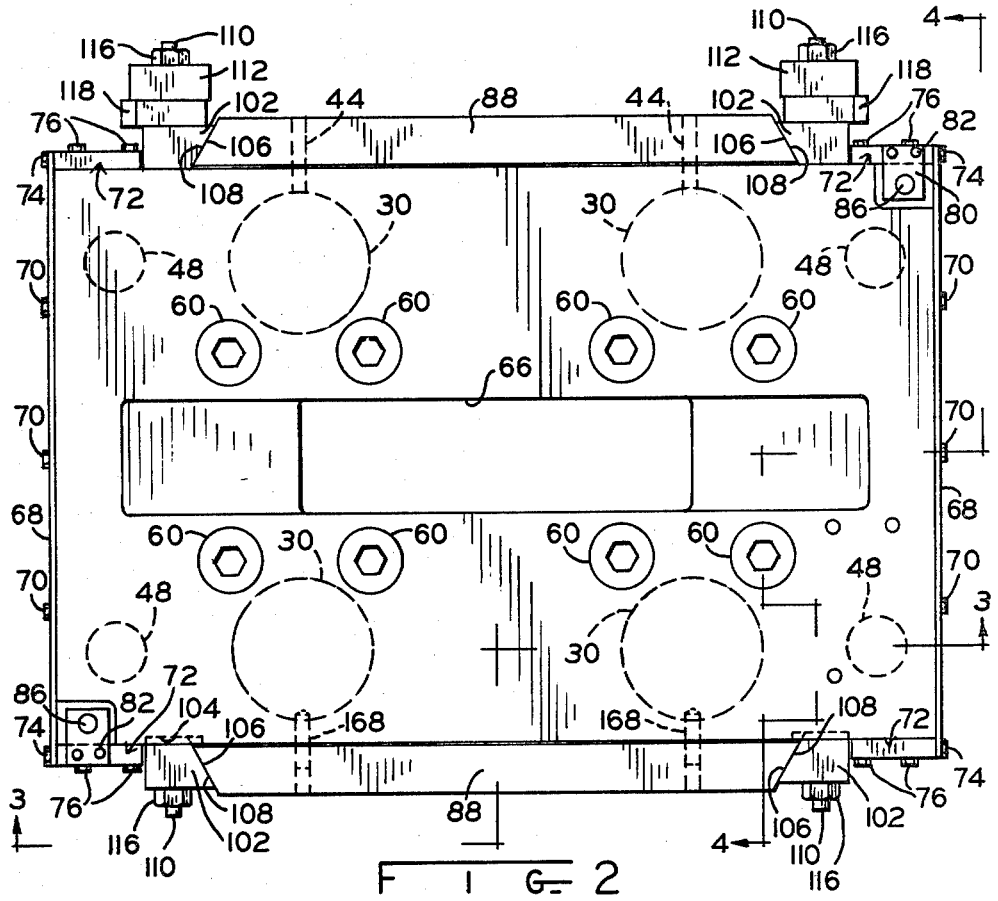
FIG. 2 is a plan view of the retracting bolster.
Figure 3:
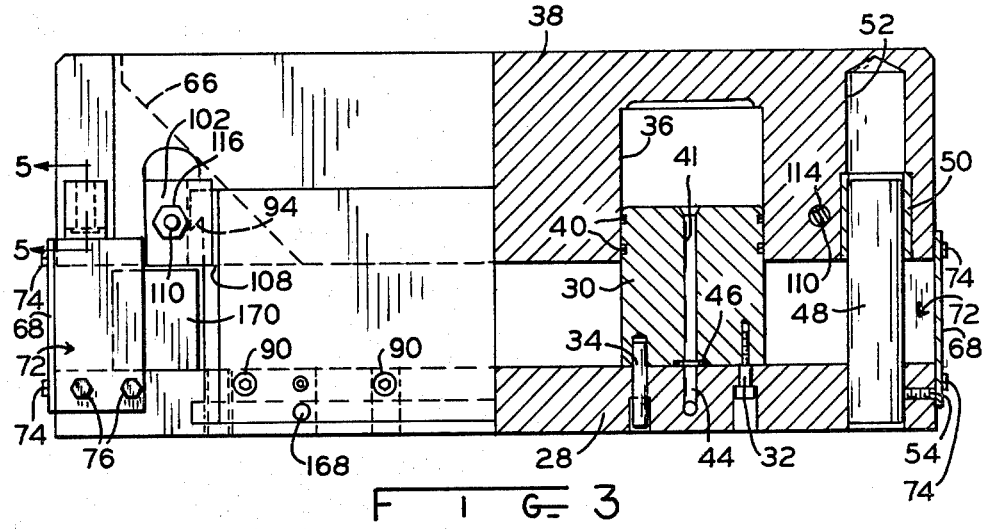
FIG. 3 is a sectional view taken along line 3—3 of FIG. 2 and viewed in the direction of the arrows.
Figure 4:
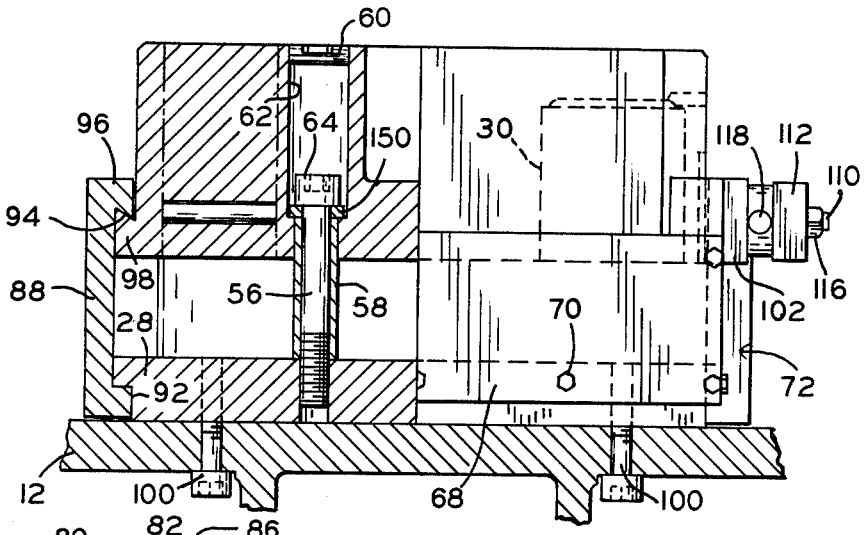
FIG. 4 is a sectional view taken along line 4—4 of FIG. 2 and viewed in the direction of the arrows.

With specific reference to the drawings, press 8 comprises a crown 10, a bed 12, and uprights 14 connecting the crown 10 to the bed 12. Uprights 14 are connected to or integral with the underneath side of crown 10 and with the upper side of bed 12. Leg members 16 are formed as extensions of bed 12 and are generally mounted on the shop floor 18 by means of shock absorbing pads 20.

The slide 22 is driven by motor 24 through a crankshaft and connecting arm arrangement (not shown), and is guided for reciprocating movement toward and away from bed 12 by the frame structure. It should be noted that the present invention is not limited to the particular press shown in the drawings and described above, but may be any type of mechanical press such as straight side presses or gap frame presses, and other types of presses such as hydraulic presses.

Figure 5:
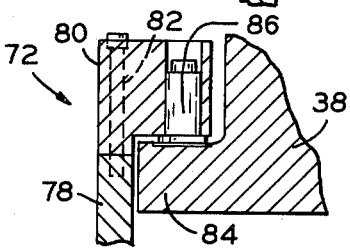
FIG. 5 is a sectional view taken along line 5—5 of FIG. 3 and viewed in the direction of the arrows.
Figure 6:
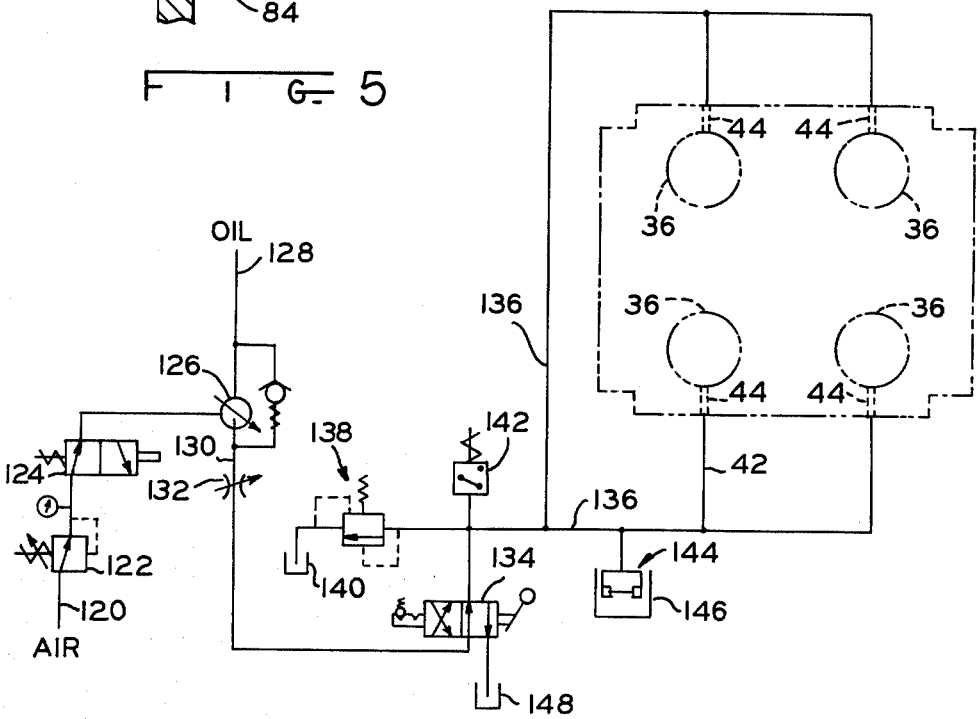
FIG. 6 is a hydraulic schematic for the retracting bolster of the present invention.

With detailed reference now to FIGS. 2 through 5, the bolster assembly 26 according to the present invention will be seen to comprise a base plate 28 to which are rigidly connected four pistons 30 by means of screws 32 and dowels 34. Pistons 30 are received within cylinders 36 formed in bolster 38 and sealed thereagainst by means of seals 40. Axial passageways 41 in pistons 30 communicate with cylinders 36 and with passageways 44, the latter being connected to hydraulic lines 42 (FIG. 6). O-rings 46 seal the interface between passageways 41 and 44.

Bolster 38 is capable of vertical sliding movement on pistons 30, with a stroke of 3.5 in., for example, and is further guided by means of guide pins 48, which are received within guide bearings 50 in guide bores 52. Guide pins 48 are rigidly secured to base plate 28 by set screws 54. Retainer bolts 56 (FIG. 4) are received within washers 150 and cylindrical spacers 58 and threadedly secured to base plate 28. Threaded caps 60 prevent dust, pieces of metal and other debris from entering the cylindrical bores 62 which accommodate the heads 64 of bolts 58 as bolster 38 is extended and retracted. Bolster 38 includes an elongated, tapered opening 66 in the center thereof.

Side guards 68 are fastened to base plate 28 by means of screws 70 and to brackets 72 by screws 74. Brackets 72, in turn, are connected to base plate 28 by screws 76. One of the two brackets 72 at diametrically opposite corners of the assembly 26 is illustrated in FIG. 5 and will be seen to comprise a lower portion 78, an L-shaped upper portion 80 connected to lower portion 78 by screws 82 and overhanging a lip 84 on bolster 38. Mounted within overhanging portion 80 is an electrical contact switch 86, which senses when lip 84 comes into contact with it, thereby providing an output signal for disabling the press from operation unless bolster 38 is in its fully extended position. For example, the output signal could be used to disable the press clutch (not shown).

Two vertical retainers 88 are rigidly secured to base plate 28 by means of screws 90 and dowels 168, and are seen to have an interlocking fit 92 with base plate 28 and a dovetailed fit 94 with bolster 38. Dovetailed fit 94 is provided by an overhanging dovetail rail portion 96 at the top of retainers 88 and an outwardly extending dovetail lip 98 at the bottom of bolster 38. The purpose of the dovetailed fit 94 between retainers 88 and bolster 38 is to achieve accurate registration of bolster 38 when it is in its fully extended position. This is necessary to ensure accurate registration between the upper and lower dies even though the bolster 38 may be retracted for maintenance and then extended for continued operation. Since base plate 28 is rigidly secured to bed 12 by means of screws 100, retainers 88 and, therefore, the fully extended position of bolster 38, will be accurately and rigidly maintained.

Four wedges 102, which are partially received within recesses 104 in bolster 38, include inclined surfaces 106 in facing relationship with corresponding inclined surfaces 108 on retainers 88. Two pairs of wedges 102 are secured together by means of tie rods 110, which extend through hydraulic cylinders 112, wedges 102 and elongated bores 114 in bolster 38. Nuts 116 hold the tie rod assemblies in place. Hydraulic cylinders 112 are connected to a source of suitable hydraulic pressure by fittings 118, which may be the same source as used for pressurizing bores 36, or a separate hydraulic source. Hydraulic cylinders 112 are preferably the hollow variety for strap or bridge type clamping, such as Enerpac Holl-o-cylinders. When hydraulic cylinders 112 are actuated, they expand in length so as to press wedges 102 inwardly against the inclined surfaces 108 of retainers 88. Since the clamping surfaces 108 and 106 are inclined to the major horizontal orthogonal axes of the assembly, bolster 38 is rigidly held against movement in any lateral direction, either coaxial with or transverse to the axes of tie rods 110.

The hydraulic schematic for the retracting bolster is illustrated in FIG. 6 and is seen to comprise a source of pneumatic pressure connected to line 120, which is connected to air regulator 122 having its output connected to valve 124. When valve 124 is in the position shown, a Haskel air-over-oil pump 126 is driven so as to increase the pressure of the 300 p.s.i. oil in line 128 to a pressure of 1200 p.s.i. in line 130 for use in developing the requisite hydraulic pressure. Needle valve 132 controls the speed of bolster expansion and has its output connected to control valve 134, which is manually actuated. With valve 134 in the position shown in FIG. 6, high pressure hydraulic fluid will be connected to line 136 and flow to cylinders 36 through lines 42, and passageways 44 and 41. Relief valve 138 is used to control excessive system pressure and has its output connected to sump 140. Pressure switch 142 is connected to the press control circuitry (not shown) and disables the press from operating until the pressure developed in line 136 is sufficient to withstand the stamping load developed by the press. Like contact switch 86, the signal produced by pressure switch 142 could be used to disable the press clutch.

If desired, the retracting bolster may be provided with an overload capability by the addition of rupture disc device 144 connected to hydraulic line 136. Rupture disc device 144 includes a brittle, frangible disc, which ruptures when the pressure exceeds a predetermined level and discharges the high pressure hydraulic fluid into sump 146. It should be noted, however, that the primary purpose of the retracting bolster is not that of overload protection, but is to afford sufficient retraction to enable access to the die by selectively throwing valve 134 to the alternative position wherein the hydraulic fluid from line 136 will be discharged into sump 148.

In operation, bolster 38 is extended by placing valve 134 in the position shown and setting valve 124 such that pneumatic pressure from regulator 122 will be connected to pump 126. Pump 126 will deliver high pressure hydraulic fluid to cylinders 36 through hydraulic lines 136 and 42 and passageways 44 and 41. This will cause bolster 38 to be extended upwardly through a distance of 3.5 inches, for example, until lips 98 engage dovetailed rails 96, and the heads 64 of bolts 56 are engaged by washers 150. At this point, hydraulic pressure is maintained at the 1200 p.s.i. level by pump 126 and press operation may be begun. The hydraulic pressure is sufficient to rigidly hold bolster 38 in its upper, extended position against the stamping force produced by the press.

Should it be necessary to gain access to the dies for maintenance or other purposes, valve 134 is thrown to its alternative position so that the high pressure hydraulic fluid in lines 136 will be discharged into sump 148. By virtue of the weight of bolster 38 and the die mounted thereto, bolster 38 will retract downwardly until it bottoms out against base plate 28. When it is desired to resume press operation, valve 134 is thrown to the position shown in FIG. 6 and pump 126 will deliver high pressure hydraulic fluid through valve 134 to hydraulic lines 136 and 42, and passageways 44 and 41 into cylinders 36. This will cause bolster 38 to be extended upwardly until dovetailed lip 98 engages dovetailed rail 96. Press operation cannot be resumed until contact switches 86 are contacted by lips 84 of bolster 38, nor until pressure sensitive switch 142 detects a sufficiently high level of hydraulic pressure in lines 136.

Should there be die misalignment, a jammed part or any other type of obstruction, when slide 22 hits this obstruction on the downstroke, abnormally high pressures will be developed on bolster 38. This will be converted to high hydraulic pressure in lines 136 thereby causing the frangible disc in rupture disc 144 to break so as to discharge the hydraulic fluid into sump 146.

In order to prevent bolster 38 from settling when the system is shut down for an extended length of time, a spacer block 170 (FIG. 3) may be inserted between base plate 28 and bolster 38.

Although the embodiment of the invention described above comprises four pistons 30, it is not so limited, and any number of pistons could be utilized depending on the size of the bolster 38. Furthermore, more than two clamp pairs may be needed, for example, three or four per side depending upon the circumstances.

A very significant advantage of the retracting bolster described above is in the case of a press jam due to a misfeed, or the like. In many presses, the technique for clearing a jam is to heat the tie rods to the point where they expand thereby permitting the slide to be backed off. In the press equipped with the retracting bolster of the present invention, however, all that is necessary is to throw valve 134 to the discharge position thereby causing bolster 38 to retract. The jam can be quickly cleared and machining resumed with a minimum of machine down time.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A press having a frame structure with a crown and a bed, a slide guided by the frame structure for reciprocating movement in opposed relation to said bed, and a bolster assembly mounted to said bed, said bolster assembly comprising:

a base mounted to said bed, a bolster having an upper surface in facing relation to said slide, said bolster being supported on said base and guided by said base for rectilinear movement in opposed relation to said bed and slide between extended and retracted positions, hydraulic piston and cylinder means associated with said base and bolster for rigidly holding said bolster in its extended position when charged with hydraulic pressure and for permitting said bolster to retract when hydraulic pressure is released, means connected to said base for rigidly holding said bolster against lateral movement relative to the axis of rectilinear movement thereof when said bolster is in the extended position, and selectively actuatable valve means for releasing hydraulic pressure in said piston and cylinder means to cause said bolster to retract to its retracted position thereby achieving slide and bolster separation sufficient to permit easy die access for maintenance purposes and the like.

2. The press of claim 1 wherein said extended and retracted positions are separated by a distance of at least two inches.

3. The press of claim 1 wherein said extended and retracted positions are separated by a distance of at least three inches.

4. The press of claim 1 wherein said extended and retracted positions are separated by a distance of at least 3.5 inches.

5. The press of claim 1 wherein said piston and cylinder means comprises a plurality of pistons mounted to said base and a plurality of cylinders formed in said bolster and slidably disposed over respective said pistons.

6. The press of claim 5 wherein hydraulic fluid is admitted to said cylinders through passageways in said pistons.

7. The press of claim 5 including guide pins rigidly mounted to one of said base or bolster and slidably received in guide bores in the other of said base or bolster.

8. The press of claim 1 wherein said valve means comprises a manually operated valve.

9. The press of claim 1 including air-over-oil pump means for providing hydraulic fluid under high pressure to said piston and cylinder means.

10. The press of claim 1 including: a hydraulic supply circuit connected to supply high pressure hydraulic fluid to said piston and cylinder means, and pressure-sensitive override means connected to said hydraulic circuit for disabling press operation unless a predetermined minimum hydraulic pressure in said circuit is maintained.

11. The press of claim 1 wherein said means for rigidly holding said bolster comprises clamp means for clamping said bolster.

12. A press having a frame structure with a crown and a bed, a slide guided by the frame structure for reciprocating movement in opposed relation to said bed, and a bolster assembly mounted to said bed, said bolster assembly comprising:

a base mounted to said bed, a bolster having an upper surface in facing relation to said slide, said bolster being supported on said base and guided by said base for movement in opposed relation to said bed and slide between extended and retracted positions, hydraulic piston and cylinder means associated with said base and bolster for rigidly holding said bolster in its extended position when charged with high pressure hydraulic fluid and for permitting said bolster to retract when the high pressure hydraulic fluid is released, selectively actuatable valve means for releasing hydraulic pressure in said piston and cylinder means to cause said bolster to retract to its retracted position thereby achieving slide and bolster separation sufficient to permit easy die access for maintenance purposes and the like, at least two movable clamp elements connected to one of said base and bolster and having first clamp surfaces, at least two second clamp surfaces on the other of said base and bolster, said second clamp surfaces being adjacent and in direct facing relation with said first clamp surfaces, and means for urging said clamp elements towards said second clamp surfaces such that said first clamp surfaces move into tight abutment with said second clamp surfaces so as to rigidly clamp said bolster against lateral movement.

13. The press of claim 12 including four said clamp elements, and wherein each of said clamp elements comprises a wedge having a first clamp surface which is inclined, two of said wedges being on one side of said bolster and the remaining two wedges being on a side of said bolster opposite said first mentioned side, said wedges being connected to said bolster by means of tie rods extending through said bolster from said first mentioned side to said side opposite thereto and being connected to the wedges on the opposite sides of said bolster.

14. The press of claim 13 including hydraulic actuators connected to respective said tie rods for drawing together the wedges connected to the respective tie rods thereby bringing said first and second clamp surfaces into tight abutment.

15. The press of claim 14 including retainers mounted to said base and being disposed on the opposite sides of said bolster, said retainers including said second clamp surfaces which are inclined and complementary to said first clamp surfaces.

16. The press of claim 12 including a retainer mounted to and extending upwardly from said base, said retainer including a portion overhanging a portion of said bolster so as to limit the upward movement of said bolster thereby accurately determining said extended position.

17. The press of claim 16 wherein said bolster has opposite sides and including a second said retainer, said retainers being on said opposite sides of said bolster.

18. The press of claim 12 wherein said bolster and said retainer overhanging portion include mating dovetails.

* * * * *